US009138064B2

(12) United States Patent
Tursi, Jr. et al.

(10) Patent No.: US 9,138,064 B2
(45) Date of Patent: Sep. 22, 2015

(54) MATTRESS WITH COMBINATION OF PRESSURE REDISTRIBUTION AND INTERNAL AIR FLOW GUIDES

(71) Applicant: FXI, Inc., Media, PA (US)

(72) Inventors: Daniel V. Tursi, Jr., Landenberg, PA (US); Christopher S. Weyl, Landenberg, PA (US); Vincenzo A. Bonaddio, Garnet Valley, PA (US)

(73) Assignee: FXI, Inc., Media, PA (US)

( * ) Notice: Subject to any disclaimer, the term of this patent is extended or adjusted under 35 U.S.C. 154(b) by 1 day.

(21) Appl. No.: 14/042,948

(22) Filed: Oct. 1, 2013

(65) Prior Publication Data

US 2014/0201925 A1 Jul. 24, 2014

Related U.S. Application Data

(60) Provisional application No. 61/754,151, filed on Jan. 18, 2013.

(51) Int. Cl.

| | |
|---|---|
| ***A47C 17/86*** | (2006.01) |
| ***A47C 21/04*** | (2006.01) |
| ***A47C 27/14*** | (2006.01) |
| ***A47C 27/15*** | (2006.01) |
| *A61G 7/057* | (2006.01) |

(52) U.S. Cl.

CPC ..... *A47C 17/86* (2013.01); *A47C 21/044* (2013.01); *A47C 27/144* (2013.01); *A47C 27/15* (2013.01); *A61G 7/05715* (2013.01); *A61G 2007/05784* (2013.01)

(58) Field of Classification Search

CPC ..... A47C 17/86; A47C 21/044; A47C 27/14–27/15; A61G 2007/05784; A61G 7/05715

USPC ..... 5/722, 423, 421

See application file for complete search history.

(56) References Cited

U.S. PATENT DOCUMENTS

| | | | |
|---|---|---|---|
| 2,425,655 | A | 8/1947 | Tompkins |
| 3,101,488 | A | 8/1963 | Meade |
| 3,266,064 | A | 8/1966 | Figman |

(Continued)

FOREIGN PATENT DOCUMENTS

| | | |
|---|---|---|
| EP | 1308112 | 5/2003 |
| EP | 200057 | 12/2008 |

(Continued)

OTHER PUBLICATIONS

U.S. Appl. No. 13/744,940 by Weyl, filed Jan. 18, 2013.

(Continued)

*Primary Examiner* — Peter M Cuomo
*Assistant Examiner* — Brittany Wilson
(74) *Attorney, Agent, or Firm* — Panitch Schwarze Belisario & Nadel LLP

(57) ABSTRACT

Body support systems such as mattresses include breathing layers that define internal air flow guides and form part of the structure for pressure redistribution. At least one air flow unit is coupled for fluid communication with the breathing layers so that heat and moisture may be drawn away from an uppermost comfort layer or body-supporting layer, through the breathing layers, and exhausted out of the body support system. Alternatively, air may be directed through permeable portions of the layers of the body support system to the uppermost layer, particularly at the torso supporting region.

30 Claims, 9 Drawing Sheets

(56) References Cited

U.S. PATENT DOCUMENTS

| | | | |
|---|---|---|---|
| 3,486,177 | A | 12/1969 | Marshack |
| 3,644,950 | A | 2/1972 | Lindsay, Jr. |
| 4,057,861 | A | 11/1977 | Howorth |
| 4,694,521 | A | 9/1987 | Tominaga |
| 4,825,488 | A | 5/1989 | Bedford |
| 5,249,319 | A | 10/1993 | Higgs |
| 5,325,551 | A | 7/1994 | Tappel et al. |
| 5,493,742 | A | 2/1996 | Klearman |
| 5,566,409 | A | 10/1996 | Klearman |
| 5,606,756 | A | 3/1997 | Price |
| 5,699,570 | A | 12/1997 | Wilkinson et al. |
| 5,745,941 | A | 5/1998 | Miller, Sr. |
| 5,794,289 | A | 8/1998 | Wortman et al. |
| 5,819,349 | A | 10/1998 | Schwartz |
| 5,882,349 | A | 3/1999 | Wilkerson et al. |
| 5,991,949 | A | 11/1999 | Miller, Sr. et al. |
| 6,108,842 | A | 8/2000 | Severinski et al. |
| 6,109,688 | A | 8/2000 | Wurz et al. |
| 6,158,070 | A | 12/2000 | Bolden et al. |
| 6,159,574 | A | 12/2000 | Landvik et al. |
| 6,272,707 | B1 | 8/2001 | Robrecht et al. |
| 6,273,810 | B1 | 8/2001 | Rhodes, Jr. et al. |
| 6,336,237 | B1 | 1/2002 | Schmid |
| 6,402,775 | B1 | 6/2002 | Bieberich |
| 6,484,334 | B1 | 11/2002 | Borders et al. |
| 6,516,483 | B1 | 2/2003 | VanSteenburg |
| 6,541,094 | B1 | 4/2003 | Landvik et al. |
| 6,591,437 | B1 | 7/2003 | Phillips |
| 6,643,875 | B2 | 11/2003 | Boso et al. |
| 6,684,434 | B2 | 2/2004 | Ellis et al. |
| 6,701,558 | B2 | 3/2004 | VanSteenburg |
| 6,721,979 | B1 | 4/2004 | Vrzalik et al. |
| 6,789,284 | B2 | 9/2004 | Kemp |
| 6,793,469 | B2 | 9/2004 | Chung |
| 6,832,398 | B2 | 12/2004 | Borders et al. |
| 6,952,852 | B2 | 10/2005 | Reeder et al. |
| 7,065,815 | B2 | 6/2006 | Buchanan |
| 7,120,950 | B2 | 10/2006 | Garrigues |
| 7,240,386 | B1 | 7/2007 | McKay et al. |
| 7,255,917 | B2 | 8/2007 | Rochlin et al. |
| 7,467,435 | B1 | 12/2008 | McKay et al. |
| 7,469,432 | B2 | 12/2008 | Chambers |
| 7,469,437 | B2 | 12/2008 | Mikkelsen et al. |
| 7,480,953 | B2 | 1/2009 | Romano et al. |
| 7,507,468 | B2 | 3/2009 | Landvik et al. |
| 7,617,555 | B2 | 11/2009 | Romano et al. |
| 7,661,163 | B1 | 2/2010 | Gallaher |
| 7,712,164 | B2 | 5/2010 | Chambers |
| 7,802,334 | B1 | 9/2010 | Larios |
| 7,908,688 | B2 | 3/2011 | Tompkins |
| 7,914,611 | B2 | 3/2011 | Vrzalik et al. |
| 7,922,461 | B2 | 4/2011 | Wang |
| 7,950,084 | B1 | 5/2011 | McKay et al. |
| 7,966,680 | B2 | 6/2011 | Romano et al. |
| RE42,559 | E | 7/2011 | Wang |
| 7,975,330 | B2 | 7/2011 | Receveur et al. |
| 8,025,964 | B2 | 9/2011 | Landvik et al. |
| 8,034,445 | B2 | 10/2011 | Landvik et al. |
| 8,104,125 | B2 | 1/2012 | Soltani et al. |
| 8,108,957 | B2 | 2/2012 | Richards et al. |
| 8,151,391 | B2 | 4/2012 | Frias |
| 8,220,090 | B2 | 7/2012 | Gowda |
| 8,234,727 | B2 | 8/2012 | Schreiber et al. |
| 8,261,387 | B2 | 9/2012 | Lipman et al. |
| 8,286,282 | B2 | 10/2012 | Kummer et al. |
| 8,332,979 | B2 | 12/2012 | Flick et al. |
| 8,881,328 | B2 | 11/2014 | Mikkelsen et al. |
| 2004/0031103 | A1 | 2/2004 | Wyatt et al. |
| 2005/0118046 | A1 | 6/2005 | Wang |
| 2005/0210595 | A1 | 9/2005 | Di Stasio et al. |
| 2005/0278863 | A1 | 12/2005 | Bahash et al. |
| 2006/0288491 | A1 | 12/2006 | Mikkelsen et al. |
| 2007/0044241 | A1 | 3/2007 | Clark |
| 2007/0271705 | A1 | 11/2007 | Woolfson et al. |
| 2008/0250568 | A1 | 10/2008 | Wu |
| 2008/0263775 | A1* | 10/2008 | Clenet ..... 5/694 |
| 2009/0056030 | A1 | 3/2009 | Bolden |
| 2009/0144903 | A1 | 6/2009 | Delvaux et al. |
| 2009/0165213 | A1 | 7/2009 | Collins et al. |
| 2009/0217458 | A1 | 9/2009 | Lord |
| 2010/0170044 | A1 | 7/2010 | Kao et al. |
| 2011/0010855 | A1 | 1/2011 | Flessate |
| 2011/0035880 | A1 | 2/2011 | Cole et al. |
| 2011/0047710 | A1 | 3/2011 | Beard |
| 2011/0067178 | A1 | 3/2011 | Lee |
| 2011/0173758 | A1 | 7/2011 | Fontaine |
| 2011/0247143 | A1 | 10/2011 | Richards et al. |
| 2011/0289685 | A1 | 12/2011 | Romano et al. |
| 2011/0308020 | A1 | 12/2011 | Vrzalik et al. |
| 2011/0314607 | A1 | 12/2011 | Woolfson et al. |
| 2012/0017376 | A1 | 1/2012 | Mikkelsen et al. |
| 2012/0065560 | A1 | 3/2012 | Siegner |
| 2012/0167303 | A1 | 7/2012 | Stroh et al. |
| 2012/0233773 | A1 | 9/2012 | Suzuki |
| 2012/0304381 | A1 | 12/2012 | Paterok |
| 2013/0025065 | A1 | 1/2013 | Chunglo |
| 2013/0042414 | A1 | 2/2013 | Schreiber et al. |
| 2013/0074272 | A1 | 3/2013 | Lachenbruch et al. |
| 2013/0104312 | A1 | 5/2013 | O'Reagan |
| 2013/0205506 | A1 | 8/2013 | Lachenbruch et al. |
| 2013/0212808 | A1 | 8/2013 | Lachenbruch et al. |

FOREIGN PATENT DOCUMENTS

| | | |
|---|---|---|
| EP | 2000057 A1 | 12/2008 |
| EP | 2526836 | 11/2012 |
| EP | 2526836 A1 | 11/2012 |
| JP | 2004-242797 | 9/2004 |
| JP | 2010-057750 | 3/2010 |

OTHER PUBLICATIONS

Office Action issued Dec. 18, 2013 in U.S. Appl. No. 13/744,940 by Weyl.

Int'l Search Report and Written Opinion issued Mar. 24, 2014 in Int'l Application No. PCT/US2013/075375.

Office Action issued Sep. 16, 2014 in U.S. Appl. No. 14/042,948.

* cited by examiner

MATTRESS WITH COMBINATION OF PRESSURE REDISTRIBUTION AND INTERNAL AIR FLOW GUIDES

CROSS-REFERENCE TO RELATED APPLICATION

This application claims priority to U.S. Provisional patent application Ser. No. 61/754,151, filed Jan. 18, 2013.

BACKGROUND

1. Field of the Invention

The present invention relates to bedding mattresses and cushions having a multi-layer construction comprised of various foam materials for support and comfort. An air blower integrated with the mattress or cushion generates air flow through the mattress or cushion to draw heat and moisture away from a top surface of the mattress or cushion. Such air flow through the mattress or cushion in either direction enhances comfort for person(s) reclining on the mattress or cushion.

2. Background

Poor body alignment on a mattress or cushion can cause body discomfort, leading to frequent body movement or adjustment during sleeping and a poor night's sleep. An ideal mattress has a resiliency over the length of the body reclining thereon to support the person in spinal alignment and without allowing any body part to bottom out. A preferred side-lying spinal alignment of a person on a mattress maintains the spine in a generally straight line and on the same center line as the legs and head. An ideal mattress further has a low surface body pressure over all or most parts of the body in contact with the mattress.

Prolonged contact between body parts and a mattress surface tends to put pressure onto the reclining person's skin. The pressure tends to be greatest on the body's bony protrusions (such as sacrum, hips and heels) where body tissues compress against the mattress surface. Higher compression tends to restrict capillary blood flow, called "ischemic pressure", which causes discomfort. The ischemic pressure threshold normally is considered to be approximately 40 mmHg. Above this pressure, prolonged capillary blood flow restriction may cause red spots or sores to form on the skin (i.e., "stage I pressure ulcers"), which are precursors to more severe tissue damage (i.e., "stage IV pressure ulcers" or "bed sores"). The preferred pressure against the skin of a person in bed remains generally below the ischemic threshold (e.g., below 40 mmHg, preferably below 30 mmHg).

Body support systems that redistribute pressure, such as mattresses or cushions, frequently are classified as either dynamic or static. Dynamic systems are driven, using an external source of energy (typically direct or alternating electrical current) to alter the level of pressure by controlling inflation and deflation of air cells within the system or the movement of air throughout the system. In contrast, static systems maintain a constant level of air pressure and redistribute pressure through use of materials that conform to body contours of the individual sitting or reclining thereon.

Although foam frequently is used in both static and dynamic body support systems, few, if any, systems incorporate foam to redistribute pressure, withdraw heat, and draw away or evaporate moisture buildup at foam support surfaces. While foam has been incorporated into some body support systems to affect moisture and heat, most of these systems merely incorporate openings or profiles in foam support layers to provide air flow paths. In addition, few, if any, systems specify use of internal air flow guides with specific parameters related to heat withdrawal and moisture evaporation at foam support surfaces (i.e., Heat Withdrawal Capacity and Evaporative Capacity, which may be quantitatively measured). Hence, improvements continue to be sought.

Consumers appreciate the body-supporting characteristics offered by mattress constructions that include viscoelastic (slow recovery) foams. However, viscoelastic foams tend to have lower air flow (breathability), and mattresses constructed with such foams tend to retain heat and moisture. Effective and reasonably priced measures to draw away heat and moisture from reclining surfaces of consumer bedding mattresses and cushions continue to be sought. Effective and reasonably priced measures to cool the reclining surfaces of consumer bedding mattresses and cushions continue to be sought.

SUMMARY

In a first embodiment, a body support system, such as a mattress, has an articulated base defining a length and a width and a longitudinal axis. The articulated base may be formed of a cellular polymer, such as polyurethane foam. In this first embodiment, the articulated base defines a cavity in which an air flow unit may be housed.

The body support system of this first embodiment has a first breathing layer disposed over the articulated base. The first breathing layer defines multiple rows of cellular polymer material wherein cellular polymer material forming at least one row has air permeability of at least 5 $ft^3/ft^2/min$. The body support system has a second breathing layer disposed over the first breathing layer. The second breathing layer defines multiple rows of cellular polymer material wherein cellular polymer material forming at least one row has air permeability of at least 5 $ft^3/ft^2/min$. At least one row of the second breathing layer is positioned in relation to at least one row of the first breathing layer to define multiple air flow paths through the first and second breathing layers with at least some of said air flow paths disposed at angles offset from vertical. In a preferred embodiment one or more additional breathing layers is/are disposed over the second breathing layer.

In this first embodiment, the multiple rows of the first breathing layer may comprise alternating rows of open cell polyurethane foam and reticulated open cell polyurethane foam, and the multiple rows of the second breathing layer may comprise alternating rows of open cell polyurethane foam and reticulated open cell polyurethane foam. The polyurethane foams may be viscoelastic foams. In one preferred embodiment, at least one row of the second breathing layer is positioned in staggered relation to at least one row of the first breathing layer.

A top sheet may be disposed over the second breathing layer. In a preferred embodiment, the top sheet is comprised of reticulated viscoelastic foam.

At least one air flow unit is coupled to the first breathing layer for drawing air and/or moisture vapor from the top surface or top sheet through the first breathing layer and the second breathing layer, or alternatively, for directing air through the first and second breathing layers to the top sheet. The air flow unit may be installed within the cavity in the articulated base.

One or more galleys may be provided in the articulated base. The galleys define air flow pathways through the thickness of the articulated base between the first breathing layer and the air flow unit.

An alternative embodiment of the body support system has a base defining a length and a width and a longitudinal axis, where said base optionally is articulated. The body support system includes at least one breathing layer disposed over at least a portion of the base, said breathing layer formed of cellular polymer material or a spacer fabric having air permeability of at least 5 $ft^3/ft^2/min$. At least one layer of reticulated viscoelastic cellular polymer material is disposed over at least a portion of the at least one breathing layer. At least one air flow unit is coupled to the at least one breathing layer for drawing air and/or moisture vapor through the breathing layer and the at least one layer of reticulated viscoelastic cellular polymer material, or for forcing air through the breathing layer and the at least one layer of reticulated viscoelastic cellular polymer material. The body support system of this embodiment may include additional support layer(s) between the base and the at least one reticulated viscoelastic cellular polymer layer.

In one preferred embodiment, the body support system has a top surface defining a head supporting region, a torso supporting region, and a foot and leg supporting region. The top surface may be composed of reticulated viscoelastic foam. In a particularly preferred embodiment, the at least one reticulated viscoelastic layer is present only at the torso supporting region, and other viscoelastic cellular polymer flanks the reticulated layer at the torso supporting region. The support layer may define a chimney cavity that either is left as a void space or is filled with an air permeable material to direct the flow of air from an air flow unit disposed in the base of the body support system, through the support layer overlying the base and to the breathing layer and the reticulated viscoelastic cellular polymer layer. Alternatively, the air may be directed from the top layer of the body support system, through the reticulated viscoelastic cellular polymer, through the breathing layer, through the chimney cavity of the support layer to the air flow unit. Preferably, the chimney cavity and cavity for the air flow unit are below the torso supporting region of the top layer of the body support system.

Another aspect of the invention is a method of moderating skin temperature and/or reducing perspiration or sweating of an individual reclining on a mattress or body support system. An air flow unit is coupled to at least one breathing layer of the body support system. The air flow unit draws air and/or moisture vapor through at least one breathing layer. Alternatively, the air flow unit forces air through at least one breathing layer to the top sheet and top surface of the mattress or cushion. With such air and/or vapor movement in either air flow direction, the surface temperature of the top surface is maintained within a comfort zone. For example, the comfort zone may be plus or minus about 5 degrees F., preferably plus or minus about 2 degrees F., of the initial skin temperature of the individual reclining on the mattress or body support system.

A more complete understanding of various configurations of the mattresses disclosed herein will be afforded to those skilled in the art, as well as a realization of additional advantages and objects thereof, by consideration of the following detailed description. Reference will be made to the appended sheets which will first be described briefly.

BRIEF DESCRIPTION OF THE DRAWINGS

The drawings described herein are for illustrative purposes only and are not intended to limit the scope of the present disclosure. In the drawings, wherein like reference numerals refer to similar components.

DETAILED DESCRIPTION

Figure 1:
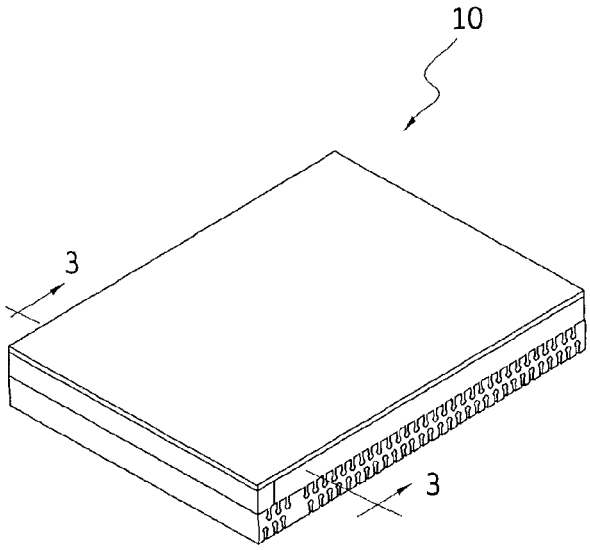
FIG. 1 is a right front perspective view of a first configuration of a mattress.

As used herein the term "body support system" includes mattresses, pillows, seats, overlays, toppers, and other cushioning devices, used alone or in combination to support one or more body parts. Also as used herein, the term "pressure redistribution" refers to the ability of a body support system to distribute load over areas where a body and support surface contact. Body support systems and the elements or structures used within such systems may be characterized by several properties. These properties include, but are not limited to, density (mass per unit volume), indentation force deflection, porosity (pores per inch), air permeability, Heat Withdrawal Capacity, and Evaporative Capacity.

Indentation Force Deflection (hereinafter "IFD") is a measure of foam stiffness and is frequently reported in pounds of force (lbf). This parameter represents the force exerted when foam is compressed by 25% with a compression platen. One procedure for measuring IFD is set forth in ASTM D3574. According to this procedure, for $IFD_{25}$ at 25%, foam is compressed by 25% of its original height and the force is reported after one minute. Foam samples are cut to a size of 15"×15"×4" prior to testing.

Air permeability for foam samples typically is measured and reported in cubic feet per square foot per minute ($ft^3/ft^2/min$). One method of measuring air permeability is set forth in ASTM 737. According to this method, air permeability is measured using a Frazier Differential Pressure Air Permeability Pressure machine. Higher values measured, using this type of machine, translate to less resistance to air flow through the foam.

"Heat Withdrawal Capacity" refers to the ability to draw away heat from a support surface upon direct or indirect contact with skin. "Evaporative Capacity" refers to the ability to draw away moisture from a support surface or evaporate moisture at the support surface. Both of these parameters, therefore, concern capability to prevent excessive buildup of heat and/or moisture at one or more support surfaces. The interface where a body and support surface meet may also be referred to as a microclimate management site, where the term "microclimate" is defined as both the temperature and humidity where a body part and the support surface are in contact (i.e. the body-support surface interface). Preferably, the measurement and calculation of Heat Withdrawal Capacity and Evaporative Capacity are conducted according to standards issued by American Society for Testing and Materials ("ASTM") International the Rehabilitation Engineering and Assistive Technology Society of North America ("RESNA").

Turning in detail to the drawings, FIGS. 1-4 show a mattress or body support system 10. The system 10 may be assembled for use as a mattress, which in this example is particularly suited for consumers for home use. Consumer mattresses, typically have a maximum overall thickness of between about 6 (six) inches to about 14 (fourteen) inches. The body support system 10 in this example comprises layers in stacked relation to support one or two persons. The configuration and orientation of these layers is described herein.

The mattress or system 10 includes an articulated base 12 that is formed of a resilient foam, such as an open cell polyurethane foam with a density in the range of about 1.8 lb/ft$^3$ to about 2.0 lb/ft$^3$, and $IFD_{25}$ of about 40 lbf to about 50 lbf. The articulated base 12 has a series of channels 14 formed in a top surface, and a series of channels 16 formed in a bottom surface. The channels 14, 16 may be formed by cutting, shaping or molding the material forming the articulated base 12. In this embodiment shown in FIGS. 1-4, the channels 14, 16 have curved or circular channel bottoms and generally straight sidewalls. The channels 14, 16 define bending locations such that the mattress 10 may be bent or contoured from a generally planar configuration to a bent or curved configuration as may be desired if the mattress 10 is used in association with an adjustable bedframe.

The articulated base 12 defines one or more hole(s) or cavity(ies) 18 that extend through the entire or substantially the entire thickness of the articulated base 12. The hole(s) or cavity(ies) 18 may be left as a void or space. Alternatively, base galley members 20 are inserted into such hole(s) or cavity(ies) 18 to define air flow paths through the articulated base 12. Base galley members 20 may comprise blocks of porous foam material with a desired air permeability, such as reticulated foam with a substantially porous and air permeable structure with a porosity ranging from about 10 pores per inch to about 90 pores per inch and air permeability values ranging from about 5 cubic feet per square foot per minute (ft$^3$/ft$^2$/min) to 1000 ft$^3$/ft$^2$/min.

Multiple breathing layers 22, 28, 34 are disposed in stacked relation over the articulated base 12. In this embodiment, three breathing layers are shown. However, the invention is not limited to three such layers, and fewer or more breathing layers may be incorporated into the mattress. Materials used to form the breathing layers may be classified as low air loss materials. Materials of this type are capable of providing air flow to a support surface for management of heat and humidity at one or more microclimate sites.

First breathing layer 22 comprises two sections, each section with rows of foam disposed in parallel relation. In each section, rows of resilient body-supporting polyurethane foam 24 are positioned alternately with rows of resilient body-supporting polyurethane foams with higher air permeability 26. The foam in each row may have a generally rectangular cross section, such as, for example, 3 inch×1.5 inch. In this embodiment, the resilient body-supporting polyurethane foam 24 may be highly resilient polyurethane foams or viscoelastic foams. In this embodiment, the resilient body-supporting polyurethane foams with higher air permeability 26 may be reticulated highly resilient polyurethane foams or reticulated viscoelastic foams. The rows 24, 26 preferably are joined together along their length, such as by adhesively bonding or by flame lamination. The first breathing layer 22 is disposed over and in contact with the top surface of the articulated base 12. Preferably, the first breathing layer 22 is not adhesively joined to the articulated base 12.

Viscoelastic open cell polyurethane foams have the ability to conform to body contours when subjected to compression from an applied load and then slowly return to their original uncompressed state, or close to their uncompressed state, after removal of the applied load. One definition of viscoelastic foam is derived by a dynamic mechanical analysis that measures the glass transition temperature (Tg) of the foam. Nonviscoelastic resilient polyurethane foams, based on a 3000 molecular weight polyether triol, generally have glass transition temperatures below −30° C., and possibly even below −50° C. By contrast, viscoelastic polyurethane foams have glass transition temperatures above −20° C. If the foam has a glass transition temperature above 0° C., or closer to room temperature (e.g., room temperature (20° C.)), the foam will manifest more viscoelastic character (i.e., slower recovery from compression) if other parameters are held constant.

Reticulated polyurethane foam materials include those materials manufactured using methods that remove or break cell windows. Various mechanical, chemical and thermal methods for reticulating foams are known. For example, in a thermal method, foam may be reticulated by melting or rupturing the windows with a high temperature flame front or explosion, which still leaves the foam strand network intact. Alternatively, in a chemical method the cell windows may be etched away using the hydrolyzing action of water in the presence of an alkali metal hydroxide. If a polyester polyurethane foam has been made, such foam may be chemically reticulated to remove cell windows by immersing a foam slab in a heated caustic bath for from three to fifteen minutes. One possible caustic bath is a sodium hydroxide solution (from 5.0 to 10.0 percent, preferably 7.5% NaOH) that is heated to from 70° F. to 160° F. (21° C. to 71° C.), preferably from 120° F. to 160° F. (49° C. to 71° C.). The caustic solution etches away at least a portion of the cell windows within the foam cellular structure, leaving behind hydrophilic ester polyurethane foam.

The resilient body-supporting polyurethane foam of the rows 24 in the first breathing layer 22 may comprise foam with an $IFD_{25}$ ranging from about 5 lbf to about 250 lbf, preferably from about 10 lbf to about 20 lbf. The higher air permeability resilient body-supporting polyurethane foam of the rows 26 in the first breathing layer 22 may comprise reticulated foam with an $IFD_{25}$ ranging from about 5 lbf to about 250 lbf, preferably from about 20 lbf to about 40 lbf. Preferably, the higher air permeability resilient body-supporting polyurethane foam of the rows 26 in the first breathing layer 22 has porosity ranging from about 10 pores per inch to about 90 pores per inch and an air permeability in the range of about 5 to 1000 ft$^3$/ft$^2$/min. The increased porosity and air permeability further allows for added control of Heat Withdrawal Capacity and Evaporative Capacity, as further described below.

The second breathing layer 28 is disposed over the first breathing layer 22. The second breathing layer 28 comprises two sections, each section with rows of foam disposed in parallel relation. In each section, rows of resilient body-supporting polyurethane foam 30 are positioned alternately with rows of resilient body-supporting polyurethane foams with higher air permeability 32. In this embodiment, the resilient body-supporting polyurethane foam 30 may be highly resilient polyurethane foams or viscoelastic foams. In this embodiment, the resilient body-supporting polyurethane foams with higher air permeability 32 may be reticulated highly resilient polyurethane foams or reticulated viscoelastic foams. The second breathing layer 28 optionally may be joined to the first breathing layer 22, such as with adhesive or by flame lamination.

The third breathing layer 34 is disposed over the second breathing layer 28. The third breathing layer 34 comprises two sections, each section with rows of foam disposed in parallel relation. In each section, rows of resilient body-supporting polyurethane foam 36 are positioned alternately with rows of resilient body-supporting polyurethane foams with higher air permeability 38. In this embodiment, the resilient body-supporting polyurethane foam 36 may be highly resilient polyurethane foams or viscoelastic foams. In this embodiment, the resilient body-supporting polyurethane foams with higher air permeability 38 may be reticulated highly resilient polyurethane foams or reticulated viscoelastic foams. The third breathing layer 34 optionally may be joined to the second breathing layer 28, such as with adhesive or by flame lamination.

The breathing layers 22, 28, 34 preferably are assembled together such that the rows of resilient body-supporting polyurethane foam are staggered or offset in respect of the rows of resilient body-supporting polyurethane foams with higher air permeability. As can be seen best in FIG. 3, the rows of resilient body-supporting polyurethane foam 36 of the third breathing layer 34 are offset vertically from the rows of resilient body-supporting polyurethane foam 30 of the second breathing layer 28. The stacked breathing layers 22, 28, 34 thus form staggered columns of resilient body supporting polyurethane foam rows generally slanted at angles away from a longitudinal center line of the body support system or mattress 10.

Figure 3:
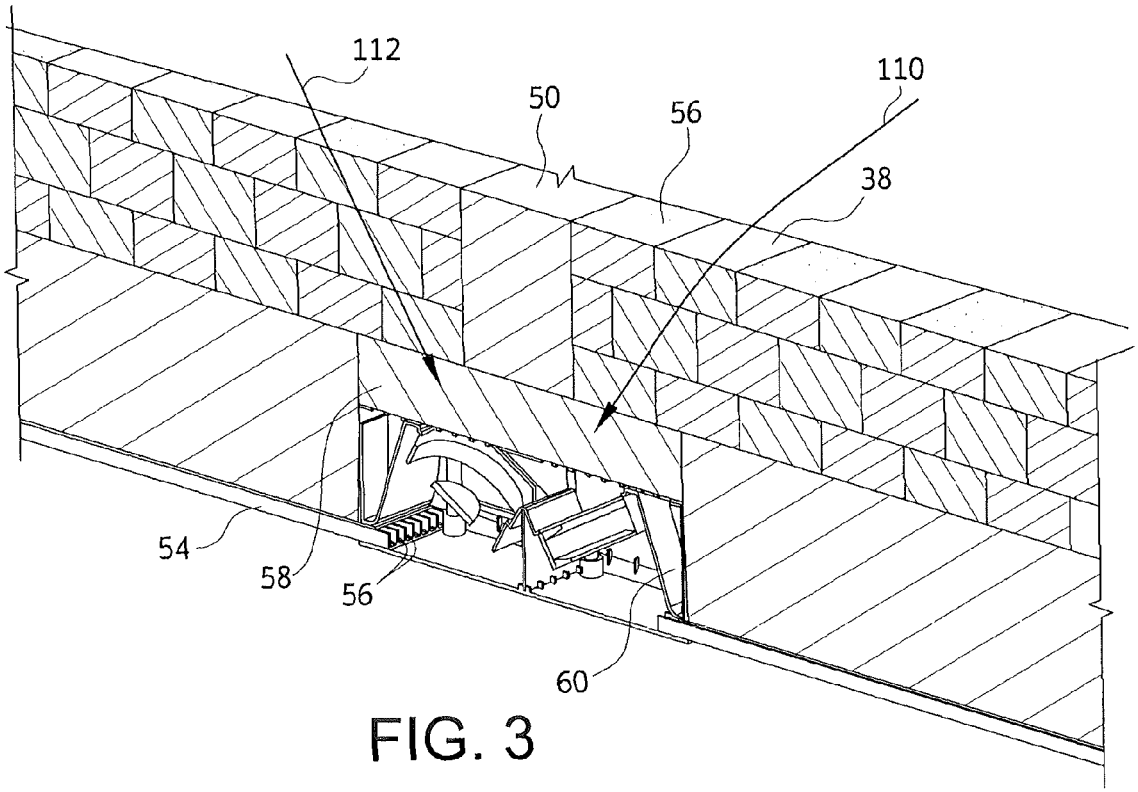
FIG. 3 is a partial cross-sectional view of the mattress shown in FIG. 1, taken along line 3-3 in FIG. 1.

Similarly, as can be seen best in FIG. 3, the rows of higher air permeability resilient body-supporting polyurethane foams 38 of the third breathing layer 34 are offset vertically from the rows of higher air permeability resilient body-supporting polyurethane foam 32 of the second breathing layer 28. The stacked breathing layers 22, 28, 34 thus form staggered columns of high air permeability resilient body supporting polyurethane foam rows generally slanted at angles away from a longitudinal center line of the body support system or mattress 10. These staggered columns of high air permeability resilient body supporting polyurethane rows 26, 32, 38 define pathways through which air and vapor may flow.

In the embodiment shown in FIG. 3, the breathing layers are positioned such that the staggered columns of higher air permeability resilient body supporting polyurethane foam rows have centerlines that disposed at an angle in the range of about 40 to about 60 degrees from vertical.

Figure 2:
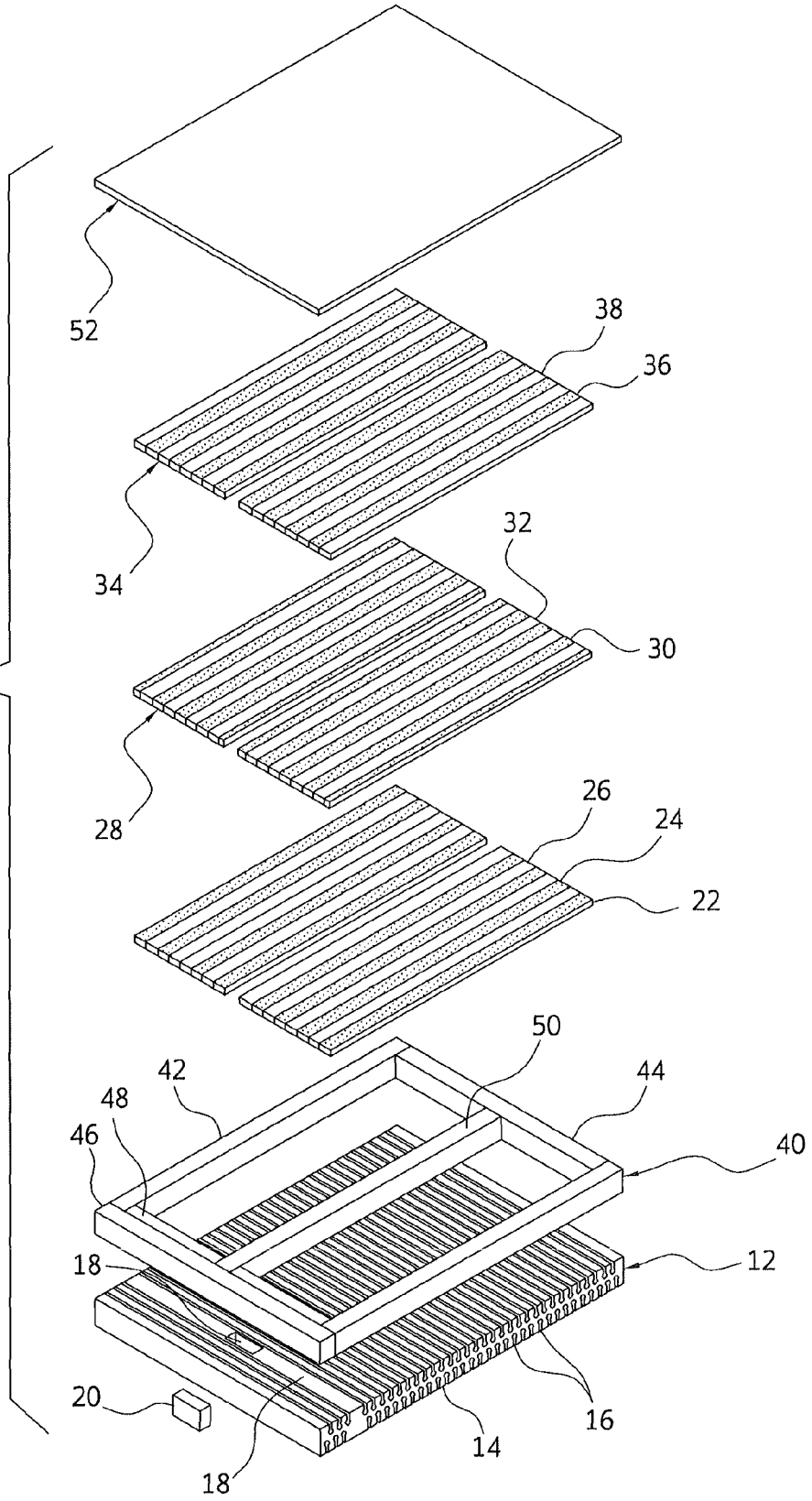
FIG. 2 is an exploded view of the mattress of FIG. 1.

The breathing layers 22, 28, 34 form a cushioning body-supportive core of the mattress 10 and are held within a surround assembly 40. Referring to FIG. 2, the surround assembly 40 has side frames or rails 42 and end frames or rails 44, 46 and 48. Frames or rails 42, 44, 46 and 48 generally comprise rectangular columns of cellular polymer material, such as polyurethane foam. The foam frames or rails 42, 44, 46 generally are firmer than other portions of the construction to support an individual when sitting at the side or end of the mattress. Each frame or rail 42, 44, 46 included in plurality of foam surrounds or rails has a density ranging from about 1.0 $lbf/ft^3$ to about 3.0 $lbf/ft^3$, and preferably from about 1.8 $lb/ft^3$ to about 2.0 $lb/ft^3$, and an $IFD_{25}$ from about 40 lbf to about 80 lbf. End frame 44 preferably is formed of a higher air permeability polyurethane foam. Inner end frame 48 is disposed adjacent end frame 46 and preferably is formed of a higher air permeability polyurethane foam. Inner end frame 48 is at the foot of the mattress 10.

Central support 50 is a column that connects at its top end to end frame 44 and at its bottom end to end frame 46. Central support 50 generally delineates the center of the supporting structure of the mattress 10 and adds stability. As shown in FIG. 2, central support 50 comprises a rectangular column of cellular polymer material, which may be the same material as used to form the side frames 42 and end frame 46, or may be the same material as used to form the body-supporting polyurethane foam of rows 24 or 26.

Although shown in FIGS. 1-4 as a multi-component surround assembly 40, the surround assembly optionally may be formed as a unitary part.

A top sheet 52 is disposed over the surround assembly 40 and the third breathing layer 34. The top sheet 52 may be formed of a higher air permeability polyurethane foam. Preferably, the top sheet 52 is formed of a reticulated viscoelastic foam. The top sheet 52 preferably has a thickness of in the range of about 0.5 inch to 3.0 inches. The top sheet 52 optionally may be joined to the top surfaces of the surround assembly 40, and optionally may be joined to the top surface of the third breathing layer 34. Preferably, the top sheet 52 rests over the top surfaces of the surround assembly 40 and the third breathing layer 34 without being joined to those surfaces.

The top sheet 52, breathing layers 22, 28, 34 and articulated base 12 preferably are together surrounded by a fire sock (not shown), such as a fire retardant knit material that resists or retards ignition and burning. The mattress 10 additionally may be encased in a protective, waterproof, moisture vapor permeable cover (not shown), such as fabric laminate constructions incorporating polyurethane coatings or expanded polytetrafluoroethylene (ePTFE). When in use, the mattress 10 may be covered by a textile bedding sheet.

One or more air flow units or blowers 80 are disposed within the mattress 10 to facilitate air flow along one or more air flow paths within the breathing layers 22, 28, 34. Air flow units or blowers 80 may be configured to generate air flow using either positive or negative pressure. Suitable air flow units include, for example, a 12V DC Blower provided by Delta Electronics. The use of air flow units 80 facilitates withdrawal from and removal of moisture and heat at body-contacting surfaces for control of both Heat Withdrawal Capacity and Evaporative Capacity of the mattress or body support system 10.

Figure 5:
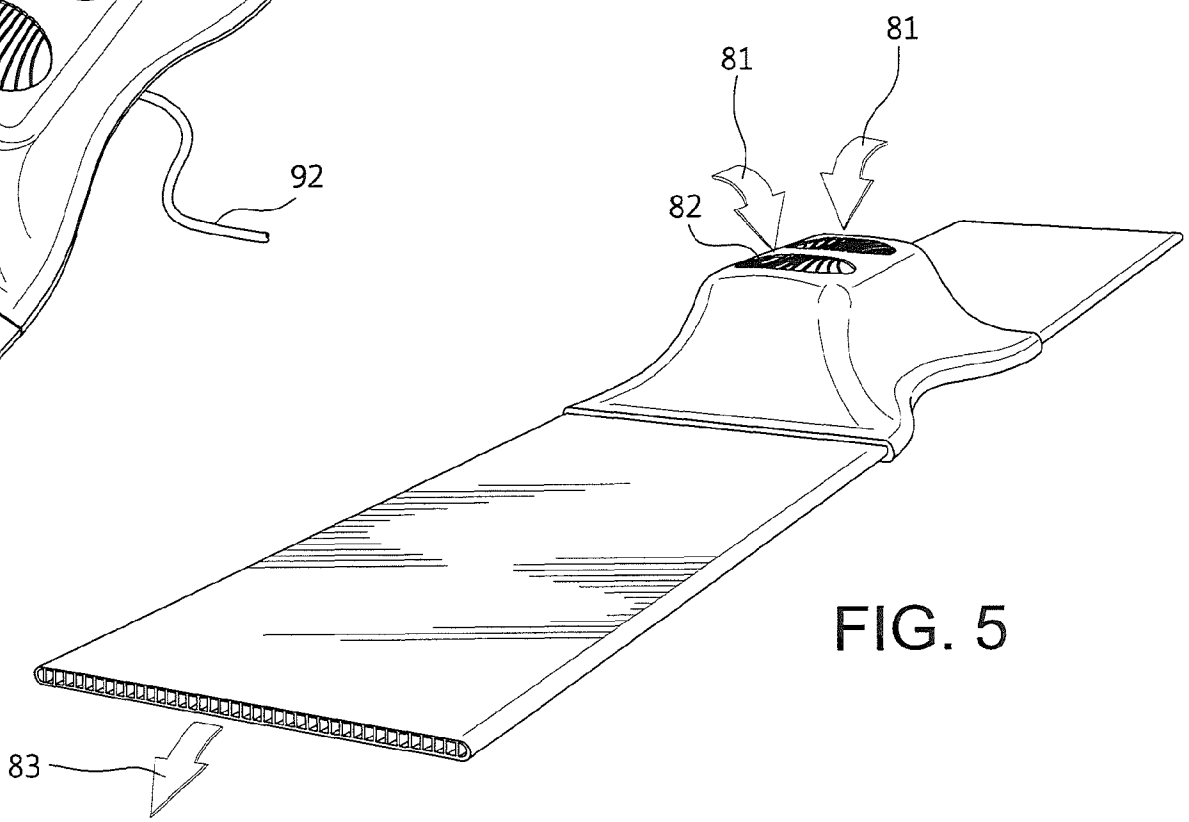
FIG. 5 is a right front perspective view of an air blower assembly.
Figure 6:
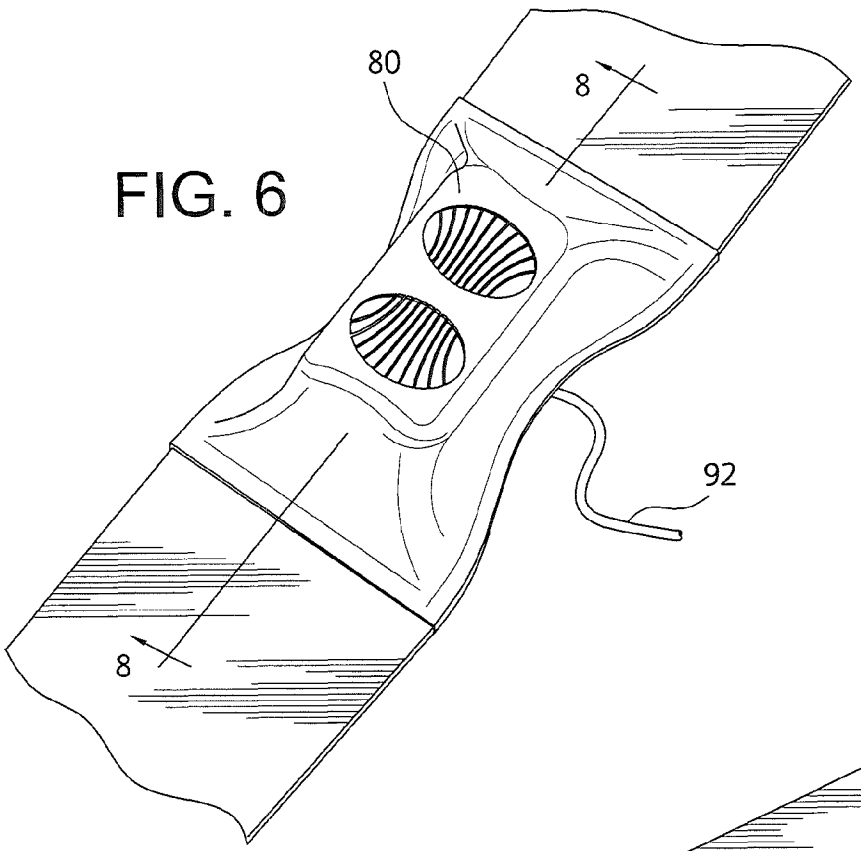
FIG. 6 is a top perspective view of the air blower assembly of FIG. 5.
Figures 7, 8:
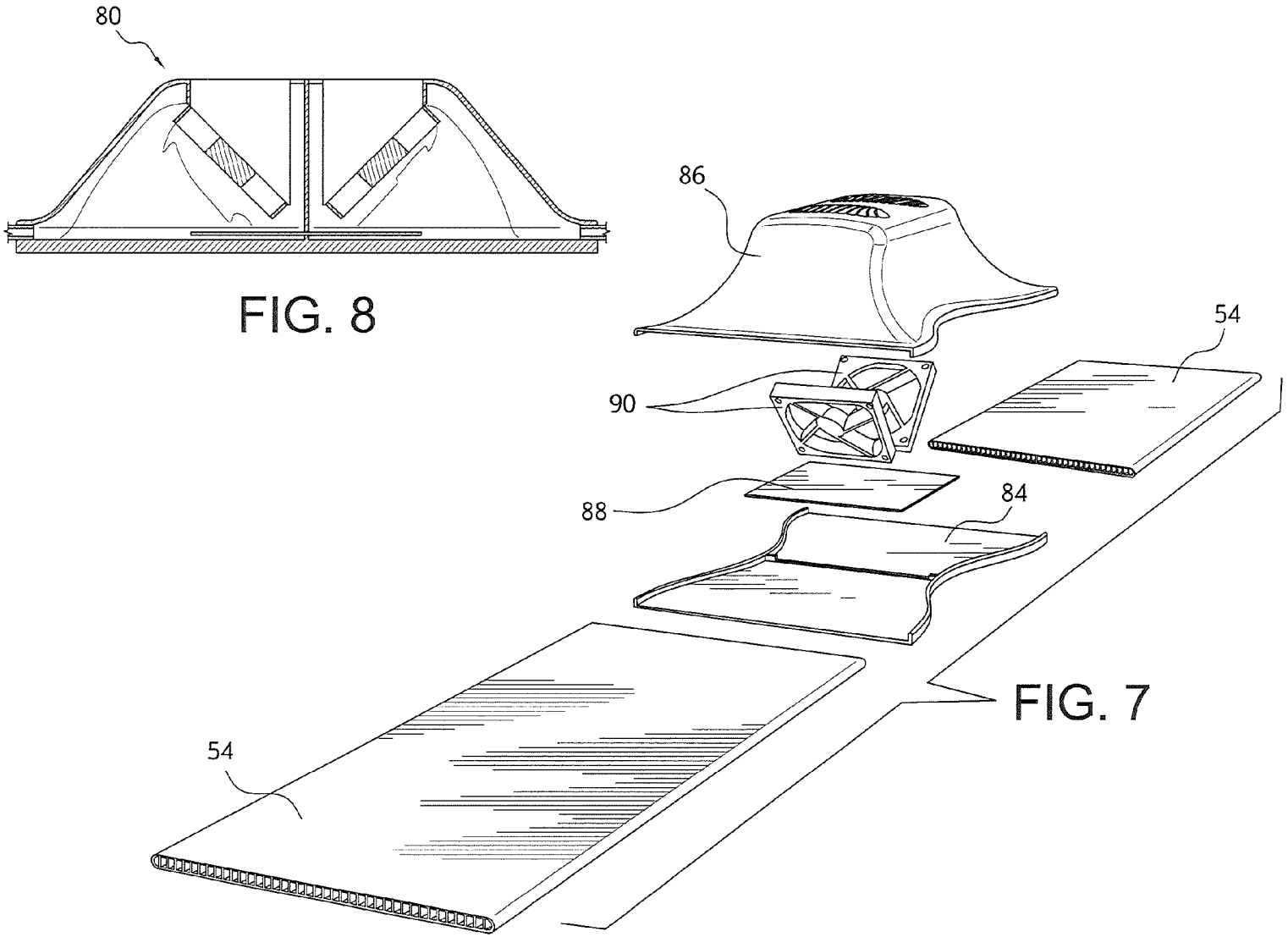
FIG. 7 is an exploded view of the air blower assembly of FIG. 5.
FIG. 8 is a cross-sectional view of the air blower assembly shown in FIG. 5, taken along line 8-8 in FIG. 6.
Figure 9:
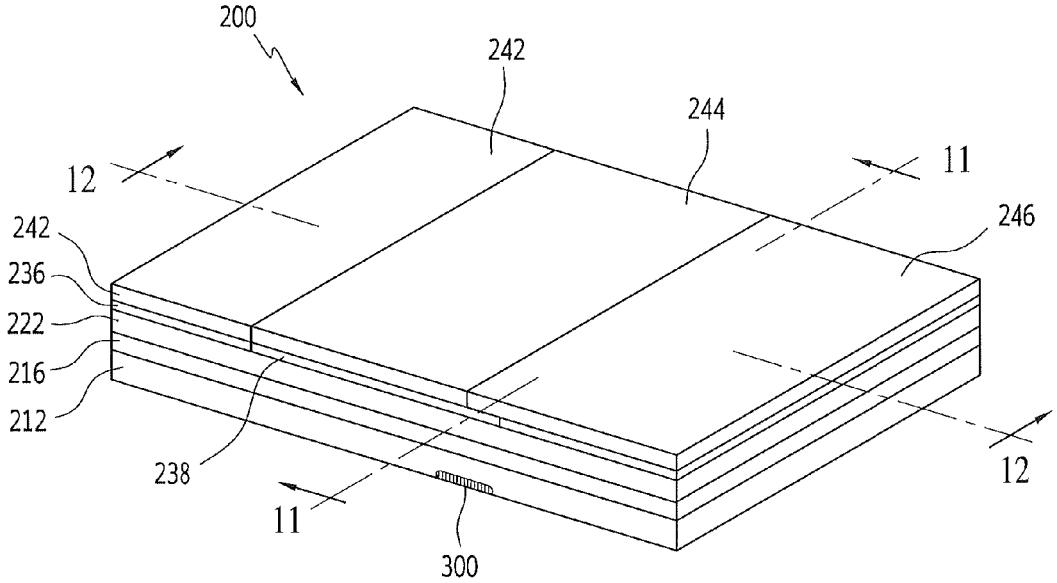
FIG. 9 is a right front perspective view of a second configuration of a mattress.
Figure 11:
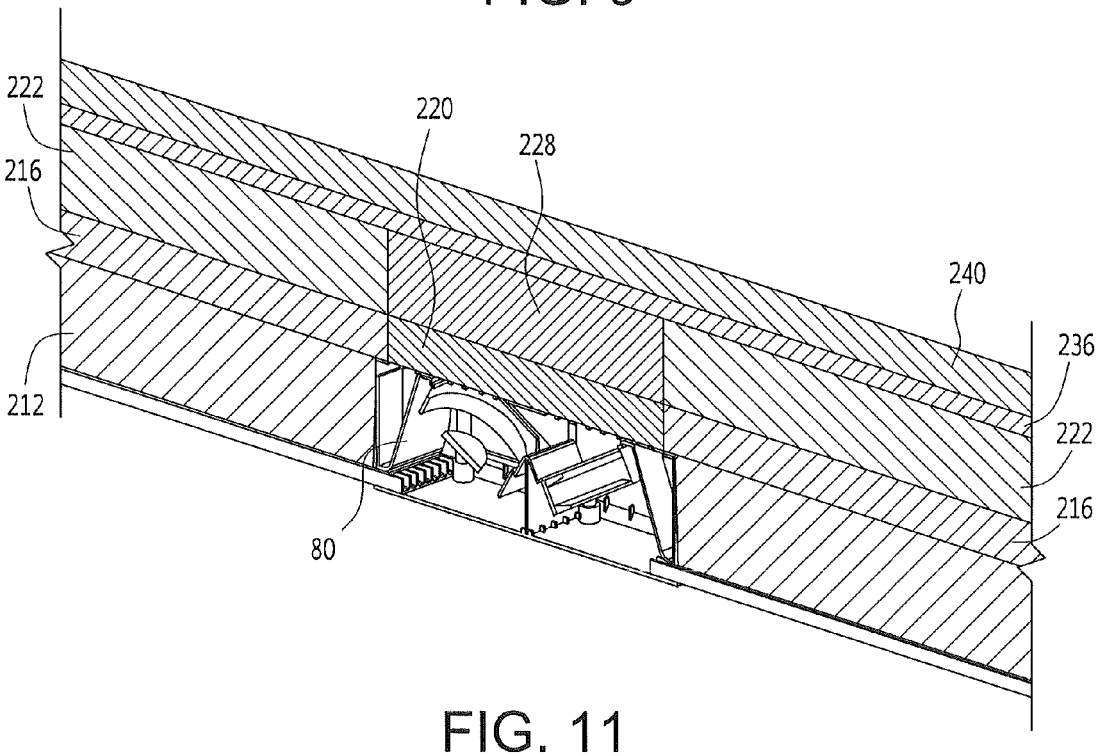
FIG. 11 is a partial cross-sectional view of the mattress shown in FIG. 9, taken along line 11-11 in FIG. 9.
Figure 10:
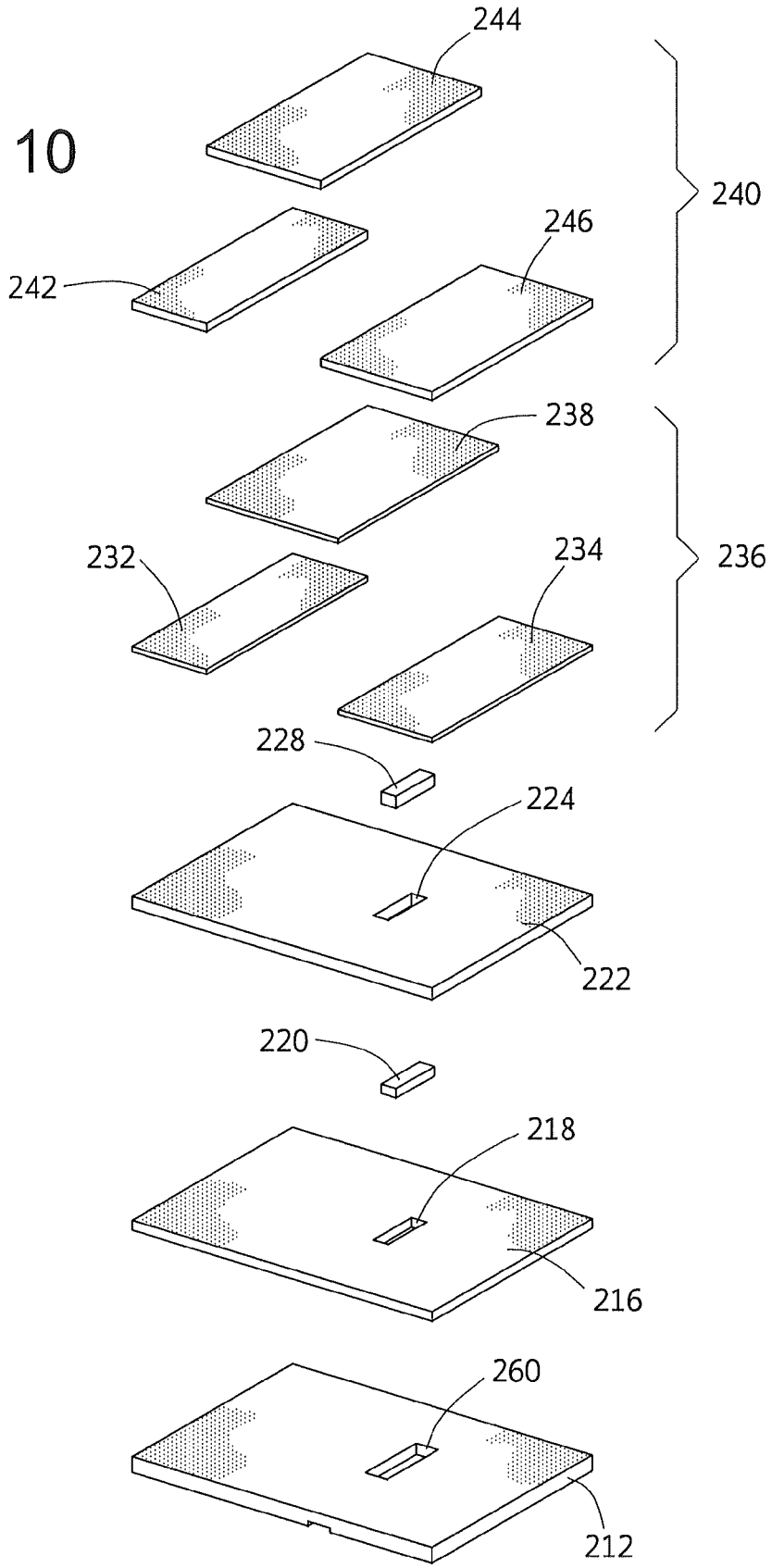
FIG. 10 is an exploded view of the mattress of FIG. 9.
Figure 13:
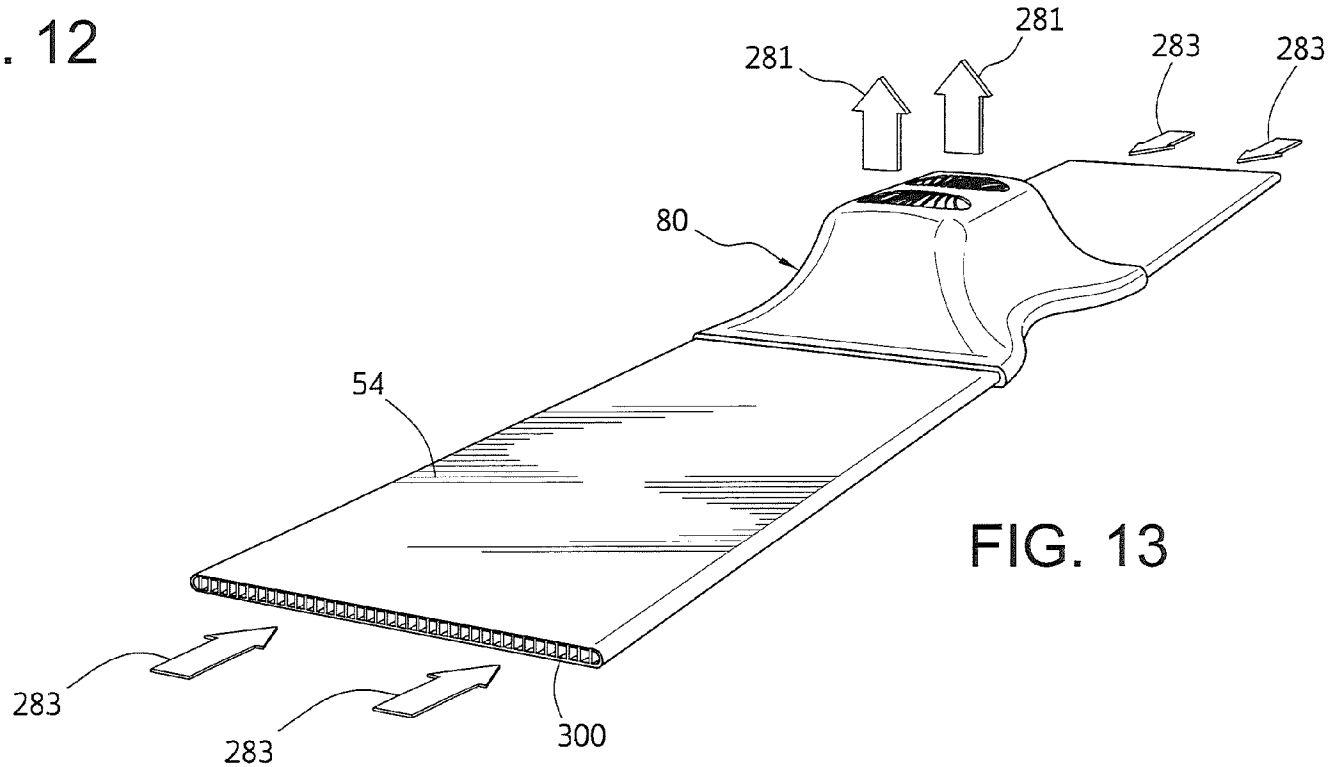
FIG. 13 is a right front perspective view of an air blower assembly illustrating air flow in an opposite direction from the air flow illustrated in respect of the air blower assembly of FIG. 5.

Referring to FIGS. 5-8, an air flow unit 80 has air inlets 82 into which air and/or vapor may be drawn (as shown by arrows 81, 83 in FIG. 5), or out of which air and/or vapor may be directed (not shown) in FIG. 5 (see FIG. 13). The air flow unit 80 includes a bottom housing 84 joined to a top housing 86 that defines an inner chamber that houses the fans or fan blade units 90 and a power control board 88. Gaps at the sides of the air flow unit are joined for fluid communication with a bottom support 54 that has spaced-apart ridges 56 defining flow channels. The bottom support 54 may be formed as an extrusion of elastomer or rubber, or may be molded from a thermoplastic or plastic material. The bottom support 54 forms a vent through which air or vapor or other fluid directed therein may flow. As shown in FIG. 7, a bottom support 54 is attached to the left side, and a separate bottom support 54 is attached to the right side of the air flow unit 80.

The air flow unit or blower 80 may be activated by connecting power connection 92 to an A/C power source. Alternatively, the air flow unit or blower 80 may be battery powered.

The air flow unit or blower 80 seats within an air blower cavity 60 formed within the articulated base 12 (see FIG. 3). The bottom support 54 is disposed under the articulated base 12 or in a cavity or depression formed in the bottom surface of the articulated base 12.

A porous bridge 58 contacts the air inlet side of the air flow unit 80 to form fluid communication between the air flow unit 80 and the first breathing layer 22. The porous bridge 58 as shown in FIG. 3 has a rectangular block configuration, and is formed of a higher air permeability polyurethane foam. The higher air permeability polyurethane foam may be a reticulated foam with an $IFD_{25}$ ranging from about 5 lbf to about 250 lbf, preferably from about 20 lbf to about 40 lbf, porosity ranging from about 10 pores per inch to about 90 pores per inch, and an air permeability in the range of about 5 to 1000 $ft^3/ft^2/min$. Alternatively, the cavity above the air flow unit 80 may be left as a void or space without inserting the porous bridge 58.

Preferably, the air flow unit or blower 80 is shrouded in foam, which includes the porous bridge 58 and the foam comprising the articulated base 12 and a covering foam to close the cavity 60. In addition, preferably, the cavity 60 is located at a bottom and central portion of the mattress 10 away from a head-supporting region. With these combined measures, noise and vibrations from the air flow unit or blower 80 are dampened to avoid disrupting a user's enjoyment of the mattress 10.

Figure 4:
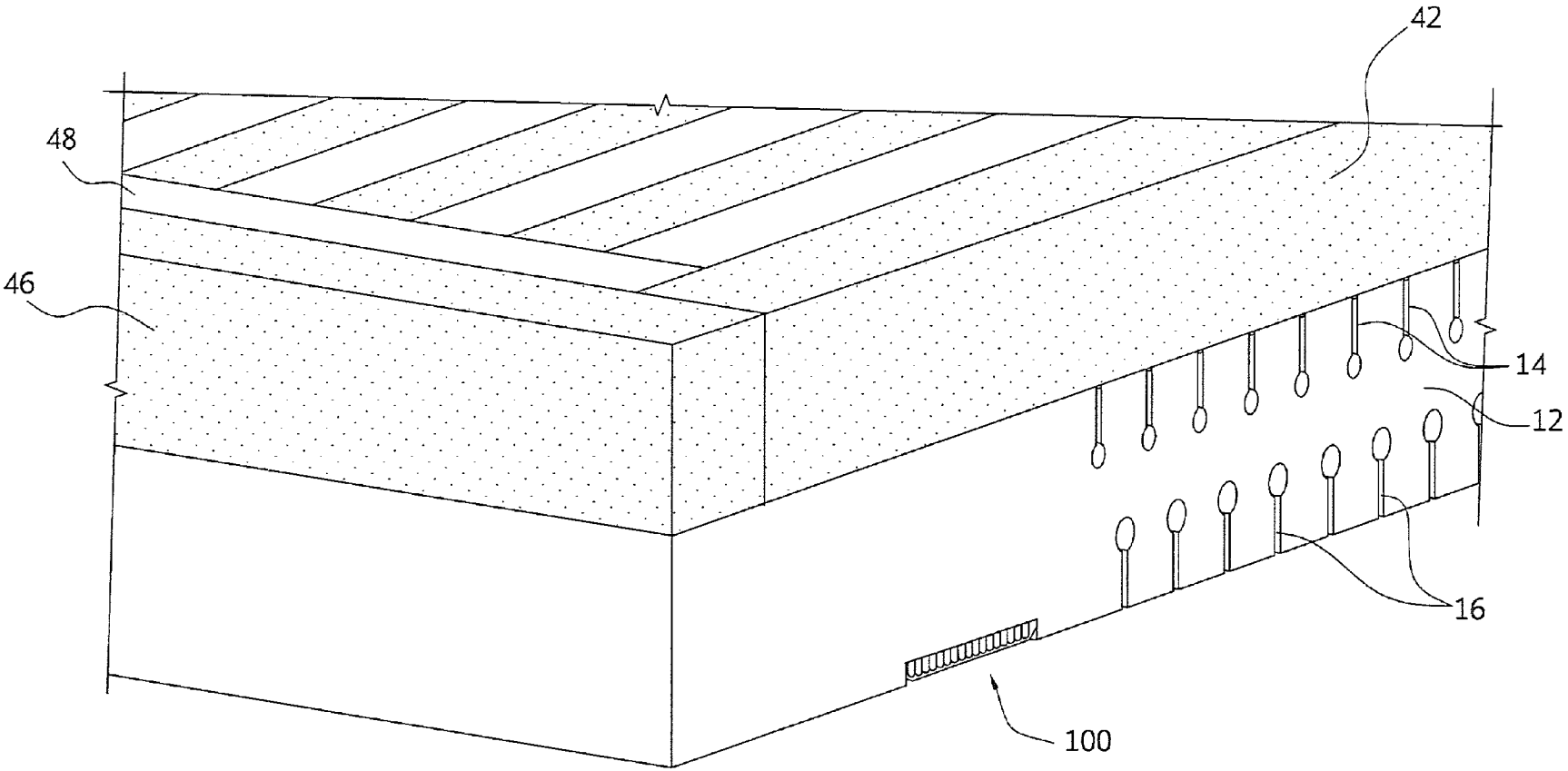
FIG. 4 is a partial right front perspective view of the mattress of FIG. 1 showing an exhaust port.

Each bottom support 54 terminates at an exhaust port 100. Preferably, as shown in FIG. 4, the exhaust port 100 is located at a side and at the bottom of the articulated base 12. Preferably, each exhaust port 100 is located at or near a foot supporting region of the mattress, and at the bottom of the articulated base 12. Such location is less apt to be covered by mattress covers, or bedding sheets. As such, the air flow and vapor flow will not be inhibited by bedding textiles or accessories. Most preferably, the bottom support 54 defines flow channels of sufficient number and dimension so that the volume of air or vapor or fluid that flows from the air flow unit 80 through the flow channels is not restricted.

An air flow unit 80 may include a screen coupled to a filter (not shown), which in combination are used to filter particles, spores, bacteria, etc., which would otherwise exit the mattress 10 into the room air. In the embodiment illustrated in FIGS. 1-8, the air flow unit 80 draws air through the body support system 10 and expels out via exhaust port 100. During operation, the air flow unit 80 may operate to reduce and/or increase pressure within the system to facilitate air flow along air flow paths from air inlets 82 to the exhaust port(s) 100. As another alternative mode of operation, the air flow unit 80 may be operated to draw air into the body support system 10 via exhaust port(s) 100 and into the breathing layers 22, 28, 34 and toward the top sheet 52 (flow direction opposite of that denoted by arrows 110, 112 for air flow pathways in FIG. 3).

A wireless controller (not shown) also may be used to control various aspects of the body support system 10. For example, a wireless controller may control the level and frequency, rate, duration, synchronization issues and power failure at surface power unit, and amplitude of air flow and pressure that travels through the system. A wireless controller also may include one or more alarms to alert a person reclining on the mattress 10 or caregiver of excessive use of pressurized air. In addition, a wireless controller also may be used to vary positioning of the body support system if the system is so configured to fold or bend.

Referring particularly to FIG. 3, representative air flow paths are delineated by arrows 110 and 112. The air flow pathways 110, 112 are facilitated by the arrangement staggered columns of higher air permeability polyurethane foam of the first breathing layer 22, second breathing layer 28, and third breathing layer 34 that direct the flow of air and/or vapor from the top sheet through the porous bridge 58 and to the air flow unit 80. The staggered columns of higher air permeability polyurethane foam form discrete pathways to direct air and/or moisture vapor flow through the internal core of the body support system 10. These internal air flow guides within the body support system 10 fulfill competing functions of pressure redistribution, moisture withdrawal or evaporation and heat withdrawal from the top surface of the mattress. The staggered columns of higher air permeability polyurethane foam that are adjacent to staggered columns of resilient body-supporting polyurethane foam offer increased softness and support than are experienced if the columns are not staggered.

Sleep comfort may be optimized if a person's skin temperature is maintained within a comfort range of plus or minus about five degrees, preferably about two degrees (±5° F., preferably ±2° F.). Breathing layers within a mattress or body support system according to the invention work in conjunction with an air flow unit or blower to moderate temperature at the top surface of the mattress or body support system. The temperature moderation or control available with the inventive mattress or body support system can be tailored so that those portions of the person's body in contact with bedding surfaces stay within a desired comfort range. For example, the speed of the air flow unit may be increased if the temperature of the top surface of the mattress or body support system exceeds the initial temperature by +5° F., preferably if the temperature of the top surface of the mattress or body support system exceeds the initial temperature by +2° F. Increasing the speed of the air flow unit draws a larger volume of air and/or moisture away from the top surface to lower temperature. Alternatively, the speed of the air flow unit may be decreased or switched off if the temperature of the top surface of the mattress or body support system is below the initial temperature by −5° F., preferably if the temperature of the top surface of the mattress or body support system is below the initial temperature by −2° F. Monitoring the top surface temperature may be with a suitable temperature sensor, and monitoring frequency may be at intervals of about 5 minutes between temperature measurements and about 30 minutes between temperature measurements.

It has been found particularly desirable to focus the air flow pathway from the torso region of the top surface of the body support system to or from the air flow unit 80. Maintaining temperature of the top surface at the torso region of the body support system is perceived favorably by most users, even if other regions of the top surface do not have means to increase or decrease air flow to maintain temperature. Thus, the embodiment of the body support system 200 shown in FIGS. 9-12 provides a reticulated viscoelastic foam top layer section 244 at least at the torso region of the top surface, and has air permeable materials coupled to that reticulated viscoelastic foam top layer section 244 and to the air flow unit 80 that are substantially below the torso region of the top surface 240.

More particularly, referring to FIGS. 9-12, a body support system 200 has a base 212 that defines a cavity 260 to house all or a portion of an air flow unit 80. In this embodiment 200, the base 212 shown in FIGS. 9-12 is not articulated or contoured to facilitate bending. As an alternative, a base comparable to the articulated base 12 of the embodiment of FIGS. 1-4 also could be used. The base 212 preferably has a thickness of about 4 to about 6 inches and is formed of an cellular polymer material, such as polyurethane foam, with a density of about 1.8 to about 2.0 $lb/ft^3$ and an $IFD_{25}$ of about 40 to about 50 lbf.

Figure 14:
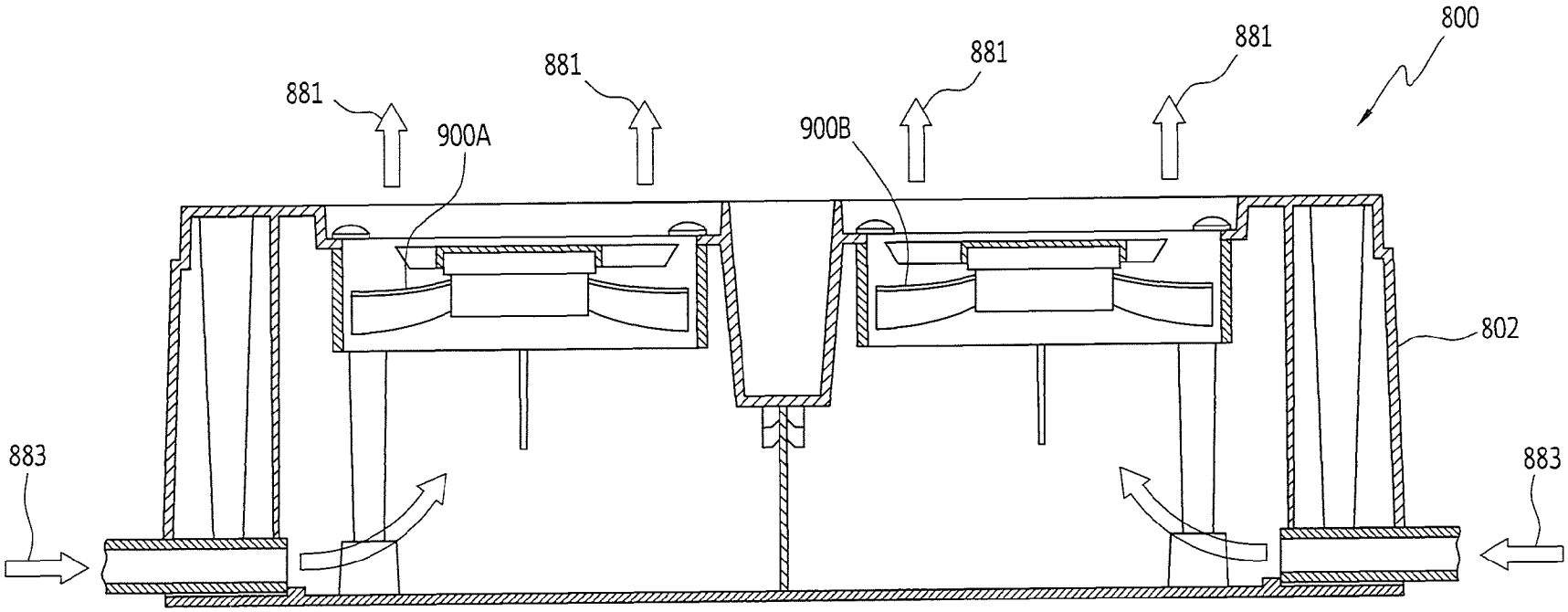
FIG. 14 is a cross-sectional view of an alternative air blower assembly that may be used in the body support systems according to the invention.

The air flow unit 80 illustrated with the body support system 200 of FIGS. 9-12 is of the same type as described above with reference to the air flow unit 80 shown in FIGS. 5-8. However, as shown in FIGS. 13 and 14, the air flow unit 80 may be activated alternatively to direct air into the body support system and to the top surface 244 of the body support system 200 by forcing air through the layers of the body support system 200, rather than drawing air away from the top surface 244 of the body support system 200. Arrows 283, 281 in FIG. 13 show the alternative direction of air flow pathways into ports 300 and out of top ports 82 of the air flow unit 80. FIG. 14 shows an alternative orientation of fans or fan blade units 90 within the air flow unit 80.

The body support system 200 has a first support layer 216 overlying the base 212. The first support layer 216 may have a thickness of about 2 to about 3 inches and may be formed of a cellular polymer material, such as polyurethane foam, with a density of about 1.3 to about 2.0 lb/ft$^3$ and an $IFD_{25}$ of about 20 to about 60 lbf. The first support layer 216 defines a cavity 218 therethrough. The first support layer 216 alternatively may be called a firm transition layer.

The body support system 200 has a second support layer 222 overlying the first support layer 216. The second support layer 222 has a thickness of about 2 to about 4 inches and may be formed of a cellular polymer material, such as polyurethane foam, with a density of about 1.3 to about 2.0 lb/ft$^3$ and an $IFD_{25}$ of from about 10 to about 60 lbf. The second support layer 222 defines a cavity 224 therethrough. When the first and second support layers 216 and 222 are in stacked relation, the cavity 218 and the cavity 224 are vertically aligned to define an air flow passageway.

In one embodiment as shown in FIGS. 9-12, chimney layer 220 is installed in the cavity 218 of the first support layer 218, and may comprise a block of porous foam material with a desired air permeability, such as reticulated foam with a substantially porous and air permeable structure with a porosity ranging from about 5 pores per inch to about 90 pores per inch, preferably about 10 pores per inch to about 30 pores per inch, and air permeability values ranging from about 5 cubic feet per square foot per minute (ft$^3$/ft$^2$/min) to about 1000 ft$^3$/ft$^2$/min. Alternatively, the region occupied by chimney layer 220 may be left as a void space or opening.

In one embodiment as shown in FIGS. 9-12, chimney layer 228 is installed in the cavity 224 of the second support layer 222 and may comprise a block of porous foam material with a desired air permeability, such as reticulated foam with a substantially porous and air permeable structure with a porosity ranging from about 5 pores per inch to about 90 pores per inch, preferably about 10 pores per inch to about 30 pores per inch, and air permeability values ranging from about 5 cubic feet per square foot per minute (ft$^3$/ft$^2$/min) to about 1000 ft$^3$/ft$^2$/min. Alternatively, the region occupied by chimney layer 220 may be left as a void space or opening.

The body support system 200 shown in FIGS. 9-12 has a first breathing layer 236 overlying the second support layer 222. The first breathing layer 236 has a thickness of about 1 to about 2 inches and may be a cellular polymer material or porous foam material with a desired air permeability, such as reticulated foam with a substantially porous and air permeable structure with a porosity ranging from about 5 pores per inch to about 90 pores per inch, preferably between about 5 pores per inch to about 10 pores per inch, and air permeability values ranging from about 5 cubic feet per square foot per minute (ft$^3$/ft$^2$/min) to about 1000 ft$^3$/ft$^2$/min. The first breathing layer 236 may be a single layer formed of the same material, or may be formed of multiple or different materials. In the embodiment shown in FIGS. 9-12, the first breathing layer has three components—a center section 238, and two sections 232, 234 adjacent to the center section 238. The center section 238 comprises the substantially porous and air permeable structure. The center section 238 is flanked by two sections 232, 234 of cellular polymer material of a similar density and hardness. However, the cellular polymer material forming sections 232, 234 in this embodiment is not air permeable or is not substantially air permeable. In this embodiment the first breathing layer 236 has a density of about 1.3 to about 2.0 lb/ft$^3$ and an $IFD_{25}$ of about 40 to about 60 lbf.

As an alternative to cellular polymers, the entire first breathing layer 236, or at least the center section 238 thereof, may be formed of a spacer fabric, such as a 3-D spacer fabric offered under the trademark Spacetec® by Heathcoat Fabrics Limited.

The body support system 200 of FIGS. 9-12 has a top layer 240 overlying the first breathing layer 236 (first breathing layer comprised of sections 232, 234 and 238). The top layer 240 has a thickness of about 0.5 to about 3 inches, preferably a thickness of from about 1 to about 2.5 inches, and may be a cellular polymer material or porous foam material with a desired air permeability, such as reticulated foam with a substantially porous and air permeable structure with a porosity ranging from about 10 pores per inch to about 90 pores per inch, preferably about 10 pores per inch to about 30 pores per inch, and air permeability values ranging from about 5 cubic feet per square foot per minute (ft$^3$/ft$^2$/min) to about 1000 ft$^3$/ft$^2$/min. Most preferably, the top layer 240 comprises a viscoelastic cellular polymer material, such as a viscoelastic polyurethane foam. The top layer 240 may be a single layer formed of the same material, or may be formed of multiple or different materials. In the embodiment shown in FIGS. 9-12, the top layer 240 has three components—a center section 244, and two other sections 242, 246 adjacent to the center section 244. The center section 244 comprises the substantially porous and air permeable structure. The center section 244 preferably is a reticulated viscoelastic cellular polymer, such as a reticulated viscoelastic polyurethane foam. In this embodiment, the center section 244 is flanked by two sections 242, 246 of cellular polymer material of a similar density and hardness. These two sections 242, 246 may be reticulated, and preferably are formed with viscoelastic cellular polymer. The viscoelastic cellular polymers (foams) forming the top layer 240 preferably have a density of about 3.0 to about 6.0 lb/ft$^3$ and an $IFD_{25}$ of about 8 to about 20 lbf.

The body support system 200 defines a head supporting region, a torso supporting region and a foot and leg supporting region. The center section 244 of the top layer 240 preferably corresponds to the torso supporting region.

Figure 12:
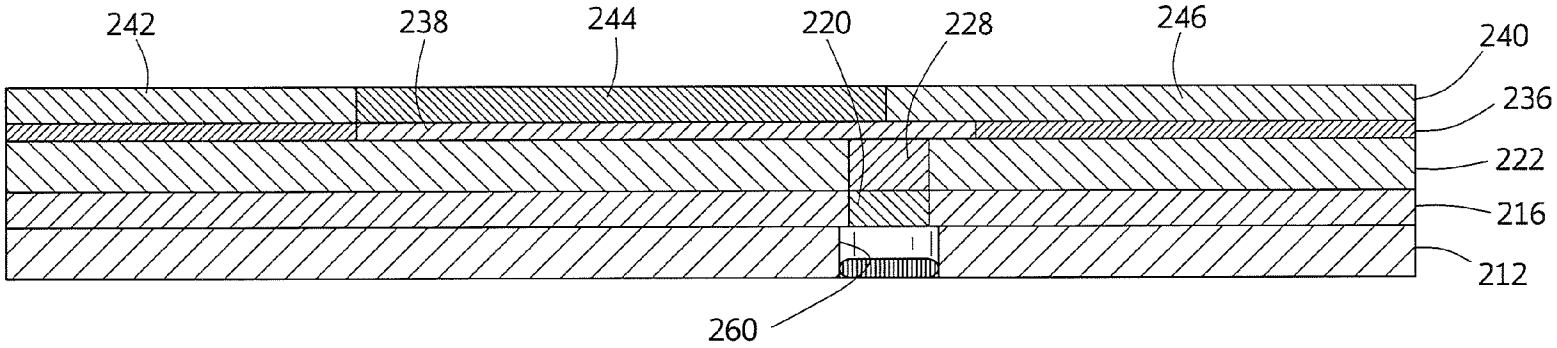
FIG. 12 is a cross-sectional view of the mattress shown in FIG. 9, taken along line 12-12 in FIG. 9.

As can be seen best in FIG. 12, the body support system 200 includes air permeable cellular polymer materials (e.g., foams, or alternatively, textile spacer fabrics) particularly at the torso supporting region and below the torso supporting region. The center section 244 of the top layer 240 is in contact with the center section 238 of the first breathing layer 236. The center section 238 of the first breathing layer 236 is in contact with the chimney layer 228 in the cavity 224 of the second support layer 222. The chimney layer 228 is in contact with the chimney layer 220 in the cavity 218 of the first support layer 216. The chimney layer 220 is adjacent the portals of the air flow unit 80 that is housed in a cavity 260 in the first support layer 212. Thus, an air flow path is defined by these porous materials at and below the torso region of the body support system 200.

In the embodiment shown in FIGS. 9-12, the air flow unit 80 is housed in a cavity 260 below or substantially below the torso supporting region of the body support system 200.

Locating the air flow unit below the torso supporting region facilitates more efficient air flow through the layers of the body support system to direct air to, or alternatively draw air away from, the torso supporting region. Notwithstanding that the air flow unit 80 is more centrally located in the body support system 200 as shown in FIGS. 9-12, noise emitted from the air flow unit 80 is not substantially more perceptible to a user reclining on the top surface of the body support system than noise emitted from the air flow unit 80 when such air flow unit is positioned below the foot and leg supporting region of the body support system 200 (compare body support system 10 of FIGS. 1-4). Hence, the advantages of the central location outweigh the disadvantages thought to arise from moving the air flow unit closer to the head supporting region of the body support system.

An alternative embodiment of an air flow unit 800 is shown in cross-section in FIG. 14. The air flow unit 800 has two propeller units 900A, 900B disposed within the housing 802. The propeller units 900A, 900B are held in a positions adjacent to one another and with their central axes perpendicular or substantially perpendicular to the opening through which air flow is expelled (or into which air flow is directed) at the air flow unit top openings. One embodiment in which the air flow unit 800 positively directs air flow into the body support system is shown in FIG. 14. Arrows 883 indicate the direction of air flow into the housing 802. Arrows 881 indicate the direction of air flow out of the housing 802 and into the chimney layer or cavity of a body support system (not shown in FIG. 14).

"Heat Withdrawal Capacity" refers to the ability to draw away heat from a support surface upon direct or indirect contact with skin. "Evaporative Capacity" refers to the ability to draw away moisture from a support surface or evaporate moisture at the support surface. Both of these parameters, therefore, concern capability to prevent excessive buildup of heat and/or moisture at one or more support surfaces. The interface where a body and support surface meet may also be referred to as a microclimate management site, where the term "microclimate" is defined as both the temperature and humidity where a body part and the support surface are in contact (i.e. the body-support surface interface).

EXAMPLES

The body support system 200 with a top surface layer of two-inch thick reticulated viscoelastic polyurethane foam was evaluated for user comfort when operated with air flow into the mattress, air flow drawn through the mattress, and without air flow. The body support system 200 was compared also with body support systems (mattresses) with nonreticulated viscoelastic foam as a top layer and with nonreticulated polyurethane foam as a top layer. Two parameters were measured with a sweating thermal sacrum test unit: (1) user body skin temperature; and (2) evaporative capacity.

The sweating thermal sacrum test was conducted following the RESNA ANSI SS-1, Sec. 4 protocol standard. Each body support system was evaluated with this method to predict body skin temperature and evaporative capacity that may be experienced by adult users reclining on the body support system.

It was determined that when evaporative capacity (reported in units $g*m^2$/hour) was maintained above 22 $g*m^2$/hour, adult test subjects should experience lower body temperatures and less sweating. Evaporative capacity above 22 $g*m^2$/hour was predictive of a more comfortable resting experience on the body support system. The average evaporative capacity for the body support system 200 was 43 $g*m^2$/hour when air flow was directed down from the upper layer and into the body support system and out through the air blower unit. The average evaporative capacity for the body support system 200 was 47 $g*m^2$/hour when the air flow was directed into the mattress through the air blower unit and up to the upper layer.

It was determined that when air flow through the body support system 200 was at a level predicted to be sufficient to maintain the adult user's skin temperature at or below 35.9° C. (96.6° F.), the adult test subjects should experience less sweating. The average predicted skin temperature for the body support system 200 was 35.8° C. when air flow was directed down from the upper layer and into the body support system and out through the air blower unit. The average predicted skin temperature for the body support system 200 was 35.7° C. when the air flow was directed into the mattress through the air blower unit and up to the upper layer.

The results from the sweating thermal sacrum test were validated by comparison with testing conducted with adult users reclining on each body support system. Five adults had three sensors taped to their backs. The individual adults rested on top of each body support system for at least six hours duration per body support system. The sensors recorded actual skin temperatures and humidity at intervals over the entire six hour test period. Daily ambient conditions were maintained consistent during the test period. Each adult participated in the study over a duration of about 2 months and reclined on each body support system at least three different times during that 2 month test period.

The maximum skin temperature measured during the six hour test period was reported for each of the mattresses tested, including the body support system 200 with its air flow turned off and with its air flow activated. It was determined that adult users experienced an average maximum skin temperature of 36.6° C. when reclining on bedding mattresses without air flow, such as those mattresses with nonreticulated viscoelastic foam as a top layer and with nonreticulated polyurethane foam as a top layer. In contrast, adult users experienced an average maximum skin temperature of 36.1° C. when reclining on the body support system 200 with active air flow directed into the mattress.

The maximum skin humidity (sweat) measured during the six hour test period was reported for each of the mattresses tested, including the body support system 200 with its air flow turned off and with its air flow activated. The values for each adult test subject were averaged. It was determined that adult users experienced an average maximum skin rH % of 77% when reclining on mattresses with nonreticulated viscoelastic top layer and without active air flow. In contrast, adult users experienced an average maximum skin rH % of 73% when reclining on the body support system 200 without air flow activated, and an average maximum skin rH % of 58% when the air flow was activated to direct air into the mattress. The discomfort threshold for maximum skin rH % is 65% as reported in 1997 by Toftum, Jorgensen & Fange, "Upper limits for indoor air humidity to avoid uncomfortably human skin". The body support system 200 performed below this discomfort threshold when the air flow was activated. The active air flow directed through the body support system 200 and toward the top layer was determined to better maintain adult user comfort by reducing skin humidity (sweat) over the entire rest period.

Thus, various configurations of body support systems are disclosed. While embodiments of this invention have been shown and described, it will be apparent to those skilled in the art that many more modifications are possible without departing from the inventive concepts herein. Moreover, the examples described herein are not to be construed as limiting. The invention, therefore, is not to be restricted except in the spirit of the following claims.

What is claimed is:

1. A body support system, comprising:

an articulated base defining a length and a width and a longitudinal axis, said articulated base having a plurality of channels defining bending locations;

a first breathing layer disposed over the articulated base, said first breathing layer defining multiple rows of cellular polymer material wherein cellular polymer material forming at least one row is a reticulated cellular polymer having an has air permeability of at least 5 $ft^3/ft^2/min$;

a second breathing layer disposed over the first breathing layer, said second breathing layer defining multiple rows of cellular polymer material wherein cellular polymer material forming at least one row is a reticulated cellular polymer having an air permeability of at least 5 $ft^3/ft^2/min$, and wherein said at least one row of the second breathing layer is positioned in relation to the at least one row of the first breathing layer to define multiple air flow paths through the first and second breathing layers with at least some of said air flow paths disposed at angles offset from vertical; and at least one air flow unit coupled to the first breathing layer for drawing air and/or moisture vapor through the first breathing layer and the second breathing layer.

2. The body support system of claim 1, wherein the multiple rows of the first breathing layer comprise alternating rows of open cell polyurethane foam and reticulated open cell polyurethane foam.

3. The body support system of claim 2, wherein the multiple rows of the second breathing layer comprise alternating rows of open cell polyurethane foam and reticulated open cell polyurethane foam.

4. The body support system of claim 1, wherein the cellular polymer material of the at least one row of the first breathing layer comprises reticulated open cell polyurethane foam or reticulated viscoelastic polyurethane foam.

5. The body support system of claim 1, wherein the cellular polymer material of the at least one row of the second breathing layer comprises reticulated open cell polyurethane foam or reticulated viscoelastic polyurethane foam.

6. The body support system of claim 1, wherein the multiple rows in the first breathing layer extend in a direction parallel to the longitudinal axis.

7. The body support system of claim 1, wherein the multiple rows in the second breathing layer extend in a direction parallel to the longitudinal axis.

8. The body support system of claim 1, wherein said at least one row of the second breathing layer is positioned in staggered relation to the at least one row of the first breathing layer.

9. The body support system of claim 1, wherein the articulated base defines a cavity in which the air flow unit is housed.

10. The body support system of claim 1, further comprising a bottom support in flow communication with the air flow unit, said bottom support defining one or more vents that terminate at an exhaust port through which air and/or moisture vapor drawn through the air flow unit flow.

11. The body support system of claim 9, wherein the bottom support comprises two sections, each of which terminates at an exhaust port, and wherein said exhaust ports are located at a torso region or at a foot region of the articulated base.

12. The body support system of claim 1, further comprising one or more galleys defining air flow pathways between the first breathing layer and the air flow unit.

13. The body support system of claim 1, further comprising a top sheet disposed over the second breathing layer, with said top sheet comprised of reticulated viscoelastic foam.

14. The body support system of claim 1, further comprising one or more additional breathing layers disposed over the second breathing layer.

15. The body support system of claim 14, further comprising a top sheet disposed over a topmost breathing layer, with said top sheet comprised of reticulated viscoelastic foam.

16. A method of moderating skin temperature and/or reducing perspiration of an individual reclining on a body support system, comprising:

supplying a body support system with at least one breathing layer and a top surface;

coupling the at least one breathing layer to an air flow unit for drawing air and/or moisture vapor through the at least one breathing layer or for directing air through the at least one breathing layer to the top surface, said air flow unit capable of adjusting its speed;

determining a first temperature of the top surface when the individual reclines on the body support system;

determining a second temperature at a time interval after the first temperature; and adjusting the speed of the air flow unit in response to a difference between the first temperature and the second temperature, wherein the top surface of the body support system defines a head supporting region, a torso supporting region and a foot and leg supporting region, and air is directed along an air flow path only to or from the torso supporting region of the top surface.

17. The method of claim 16, wherein the speed of the air flow unit is increased if the second temperature is 2 or more degrees F. higher than the first temperature.

18. The method of claim 16, wherein the speed of the air flow unit is decreased if the second temperature is 2 or more degrees F. lower than the first temperature.

19. The method of claim 16, wherein the time interval is between about 5 minutes and about 30 minutes.

20. A body support system having a top surface defining a head supporting region, a torso supporting region, and a foot and leg supporting region, comprising:

a base defining a length and a width and a longitudinal axis;

at least one breathing layer disposed over at least a portion of the base, said breathing layer formed of cellular polymer material having air permeability of at least 5 $ft^3/ft^2/min$;

at least one layer of reticulated viscoelastic cellular polymer material disposed over at least a portion of the at least one breathing layer corresponding to the torso supporting region of the body support system; and at least one support layer disposed between the base and the at least one breathing layer to support the breathing layer and at least one layer of reticulated viscoelastic cellular polymer material; and at least one air flow unit coupled to the at least one breathing layer for drawing air and/or moisture vapor through the breathing layer and the at least one layer of reticulated viscoelastic cellular polymer material and away from the torso supporting region of the body support system, or for forcing air through the breathing layer and the at least one layer of reticulated viscoelastic cellular polymer material to the torso supporting region of the body support system.

21. The body support system of claim 20, further comprising at least one additional viscoelastic cellular polymer layer disposed over the support layer.

22. The body support system of claim 20, wherein the support layer defines a chimney cavity, and cellular polymer material of greater air permeability than said support layer is held within said chimney cavity.

23. The body support system of claim 20, wherein the at least one reticulated viscoelastic layer is present only at the torso supporting region.

24. The body support system of claim 20, wherein the at least one reticulated viscoelastic layer is present at the head supporting region or foot and leg supporting region, or both said regions, in addition to the torso supporting region.

25. The body support system of claim 20, wherein the base defines a cavity into which at least a portion of the air flow unit is installed.

26. The body support system of claim 25, wherein the cavity defined in the base is below the torso supporting region.

27. The body support system of claim 26, wherein the support layer defines a chimney cavity, and cellular polymer material of greater air permeability than said support layer is held within said chimney cavity, and wherein an air flow pathway is defined from the cavity housing the air flow unit through the chimney cavity to the reticulated viscoelastic cellular polymer material layer.

28. The body support system of claim 27, wherein the air flow pathway directs air to the torso supporting region or draws air away from the torso supporting region.

29. The body support system of claim 20, wherein the at least one breathing layer is formed from a reticulated cellular polymer or an air permeable spacer fabric.

30. A body support system having a top surface defining a head supporting region, a torso supporting region, and a foot and leg supporting region, comprising:

a base defining a length and a width and a longitudinal axis;

at least one breathing layer disposed over at least a portion of the base, said breathing layer formed of cellular polymer material having air permeability of at least 5 $ft^3/ft^2/min$;

at least one top layer comprising at least in part an air permeable material, with the air permeable material of said at least one top layer disposed over the at least one breathing layer corresponding to the torso supporting region of the body support system, but not over the at least one breathing layer corresponding to the head supporting region or the foot and leg supporting region; and at least one air flow unit coupled to the at least one breathing layer for drawing air and/or moisture vapor through the breathing layer and the at least one top layer of air permeable material and away from the torso supporting region of the body support system, or for forcing air through the breathing layer and the at least one layer of air permeable material to the torso supporting region of the body support system.

* * * * *